US006260318B1

(12) United States Patent
Herren

(10) Patent No.: US 6,260,318 B1
(45) Date of Patent: Jul. 17, 2001

(54) UNITARY METAL BRIDGE, FIRE STOP AND BACKING DEVICE

(76) Inventor: Thomas Ross Herren, 1160 N. Blue Gum Ave., Anaheim, CA (US) 92806

( * ) Notice: Subject to any disclaimer, the term of this patent is extended or adjusted under 35 U.S.C. 154(b) by 0 days.

(21) Appl. No.: 09/481,965

(22) Filed: Jan. 12, 2000

(51) Int. Cl.[7] ..... E04B 1/94
(52) U.S. Cl. ..... 52/317; 52/690; 52/696
(58) Field of Search ..... 52/317, 696, 663, 52/664, 650.2, 690, 712

(56) References Cited

U.S. PATENT DOCUMENTS

| | | | |
|---|---|---|---|
| D. 271,849 | 12/1983 | Kunz | D8/384 |
| 1,867,449 | 7/1932 | Ecket | 52/317 |
| 2,994,114 | 8/1961 | Black | 52/317 |
| 4,007,570 | 2/1977 | Hunter | 52/317 |
| 4,658,556 | 4/1987 | Jenkins | 52/317 |
| 4,791,766 | 12/1988 | Egri, II | 52/320 |
| 5,189,857 | 3/1993 | Herren | 52/317 |

OTHER PUBLICATIONS

Metal Lite, Inc. Product Brochure (1997).

*Primary Examiner*—Beth A. Stephan
*Assistant Examiner*—Naoko Slack
(74) *Attorney, Agent, or Firm*—Mark H. Plager

(57) ABSTRACT

The present invention relates to wall construction, and more particularly to a new and improved means for bracing parallel studs, draft dampening between parallel studs within interior wall structures, and anchoring hand rails and grab bars to walls using a single unitary device. A one piece elongated metal plate is inserted transversely between parallel metal studs to provide the largest percentage of closure between metal studs thereby forming a fire stop (also known as a draft dampener) within the completed wall assembly and simultaneously providing a metal backing for the installation of handrails and grab bars in conformity with requirement of the Americans with Disabilities Act and Uniform Building Code requirements. The insertion of this one piece elongated plate further serves to reinforce the strength of metal studs permitting the use of lighter gauge metal studs resulting in construction cost savings.

7 Claims, 4 Drawing Sheets

UNITARY METAL BRIDGE, FIRE STOP AND BACKING DEVICE

CROSS-REFERENCES TO RELATED APPLICATIONS

None.

BACKGROUND OF THE INVENTION

1. Field of the Invention

The present invention relates to wall construction, and more particularly to a new and improved means for bracing parallel studs, draft dampening between parallel studs within interior wall structures, and anchoring hand rails and grab bars to walls using a single unitary device. The present invention provides the largest percentage of closure between metal studs thereby forming a fire stop (also known as a draft dampener) within the completed wall assembly thereby preventing fire from traveling between parallel studs within a completed wall assembly. Simultaneously, the present invention provides a means to reinforce construction studs by transversely bracing the parallel studs against each other. Additionally, the claimed invention provides a means for anchoring wall mounted structures, e.g., handrails and grab bars.

2. Description of Prior Art

Historically, the framework of a building wall was formed entirely of wood members, including wooden studs. In recent years, however, the use of metal studs has gained acceptance, and is mandated for use in buildings greater than four stories, i.e., commercial buildings, such as office buildings and hospitals. It has been found that metal studs can be advantageously employed, since a suitable metal, such as galvanized steel, is stronger than wood, will not rot, is not subject to damage by pests such as termites, remains resistant to fire, and is economically feasible.

Metal studs are typically formed of sheet metal bent to encompass a cross sectional area having nominal dimensions of two inches by four inches. To conform to architectural plans and building code requirements, metal studs are formed of sheet metal bent into generally "u"-shaped cross-section in which a relatively broad central base is flanked by a pair of narrower sides that are bent at right angles to the base. The base typically has a uniform nominal width of either four inches or 3⅝ inches which is commonly referred to as the "web." The sides of the "u"-shaped stud typically extends a nominal distance of two inches from the base which are commonly referred to as "flanges." To enhance structural rigidity the flanges of the stud, the flanges are normally bend over into a plane parallel to and spaced from the plane of the web. These turned over edges of the sides thereby form marginal lips which are typically one quarter to one half inch in width. Conventionally, the metal studs are erected with the webs oriented on the same side in the same direction.

In building construction there are certain situations which require the building studs to be braced or linked transversely to provide enhanced structural rigidity. The studs must be transversely bridged when they are over eight feet in length so that they provide adequate stability in a lateral direction within the wall which they support.

In certain instances, the metal studs require transverse backing between the studs in a building so to provide structural support against forces acting normal to or parallel to the plane of the wall assembly. For example, structural backing must be provided between adjacent parallel studs to provide necessary structural stability for the installation wall structures such as hand rails and grab bars must which conform to requirements of the Americans with Disabilities Act, i.e., withstand 250 pounds of point load pressure outward and downward parallel to the plane of the wall.

The use of fire-stops, bridging and backing in construction trade is well known in the prior art. Construction Codes and Fire Codes requires that these devices be positioned between metal studs to: (1) reinforce uniformly laterally spaced parallel metal studs; (2) discourage the spread of fire, smoke and gases within interior walls; and (3) anchor hand rails and grab bars to metal studs. The claimed invention is an improvement over the prior art based upon the accomplishment of these three tasks using only one unitary device in lieu of two or more separate devices as required by the prior art. It is therefore an object of the present invention to provide a new and improved unitary bridging, backing and fire-stop device which has all the advantages of the prior and none of the disadvantages.

First, the claimed invention provides for bridging between parallel metal studs to reinforce the studs. The device bridges the span between the parallel studs thereby reinforcing studs one against the other.

Second, the claimed invention provides for fire stopping in accordance with the BOCA National Building Code and the anticipated International Building Code. The BOCA Code defines "draft stopping" as "building materials installed to prevent the movement of air, smoke, gases, and flame to other areas of the building through large concealed passages." See BOCA §7.02.0 (1999). The International Building Code ("I.B.C.") defines a "Fireblocking"as "building materials installed to resist the free passage of flame to other areas of the building through concealed spaces." International Building Code §702.1 (1998). The I.B.C. further defines a "Draft Stop" as "a material, device or construction installed to restrict the movement of air within open spaces of concealed areas of building components . . . " Id. The claimed unitary solid metal invention installed between parallel studs in interior wall assemblies creates a fire-resistive blockage within the wall assembly which impedes the movement of air, smoke, gases and flames within the hollow interior wall assembly by sectioning the hollow cavity formed within interior wall assemblies. The use of the claimed invention conforms to the requirements of the above building codes.

Third, the claimed invention serves as backing for the installation of handrails and grab bars which are now required by the Americans with Disabilities Act. The claimed invention anchors the hand rail and grab bar to the parallel studs which form the interior wall assemblies. The anchorage to the parallel studs provided by the claimed invention permits the installation of handrails and grab bars which can with stand 250 pounds of point load pressure in accordance with the Americans with Disabilities Act. See Americans With Disabilities Act (ADA) Accessibility Guidelines for Buildings and Facilities, 56 *Federal Register* 35408 (Jul. 26, 1991).

Another object of the claimed invention is the provision of a unitary device for fire stop, bridging and backing which is simple in construction and economical in cost. Prior to the existence of the claimed invention, contractors were required to install at least two separate devices to achieve the three objects of the claimed invention: (1) metal stud support (i.e., bridging); (2) fire stoppage (vis a vis draft dampening); and, (3) a means for anchoring hand rails and grab bars. Accordingly, the cost of construction is now reduced since only the claimed invention may be used in lieu of two separate devices to accomplish bridging, fire stop and backing.

Still another object of the claimed invention is that it may be used in wall assemblies formed by vertical parallel studs or horizontal parallel studs.

One such product which may be replaced by the claimed invention is protected by U.S. Pat. No. 4,791,766 issued on Dec. 20, 1988. The product claimed by U.S. Pat. No. 4,791,766 merely provides a fire stop within interior wall assemblies without providing for support of parallel studs and a means to anchor hand rails and grab bars.

Similarly, U.S. Pat. No. 4,658,556 issued on Apr. 21, 1987 merely discloses a device for the support of parallel studs. The invention claimed in U.S. Pat. No. 4,658,556 is devoid of fire blocking capabilities as well as suitable means to secure hand rails and grab bars. In comparison, the invention claimed herein is easier and cheaper to install in light of the use of self-tapping screws in lieu of metal pegs impacted using a clincher device which require additional labor and steel costs.

Prior art claimed by U.S. Pat. No. 5,189,857 merely provided bridging to support parallel studs and backing to anchor hand rails and grab bars. However, to serve as an anchor for handrails and grab bars, the invention claimed in U.S. Pat. No. 5,189,857 is installed in a manner which compromises its ability to serve as a fire stop. Likewise, if the claimed invention was installed horizontally to serve as a fire stop mechanism the invention could not simultaneously be used to anchor hand rails and grab bars.

Likewise, U.S. Pat. No. 1,867,449 issued on Jul. 12, 1932 merely provides bridging to support parallel studs and fire block capabilities. The invention fails to provide a means for the attachment of hand rails and grab bars. Similarly U.S. Pat. Nos. 1,867,449, 2,994,114, and Des. 271,849 suffer from the same deficiency as U.S. Pat. No. 1,867,449.

Additional prior art known as NOTCH-TITE® and STAIR-TITE™ manufactured by Metal-Lite, Inc., Anaheim, Calif. does not possess the ability to provide bridging, backing and fire stop in one unitary device. NOTCH-TITE® and STAIR-TITE™ alone serve only as a backing device for hand rails and grab bars. Specifically, NOTCH-TITE® is installed transversely across studs in a wall assembly that form level corridors for the purpose of attaching hand rails and grab bars. In contrast, STAIR-TITE™ is installed perpendicularly across studs which form a wall assembly in stair wells for the purpose of attaching hand rails and grab bars in coordination with the rise of the stairs. Both NOTCH-TITE® and STAIR-TITE™ fail to provide bridging support between parallel studs because the support is not centrally located between the studs, but rather is attached along one side of the parallel studs without reinforcing the opposite side. In the absence of central support between the parallel studs, the parallel studs will twist and potentially buckle on the unsupported side. Additionally, both NOTCH-TITE® and STAIR-TITE™ fail to provide any means for fire stop. Accordingly, a separate fire stop device and bridging device must be employed to obtain the results of the claimed invention. The installation of these two additional devices in combination with NOTCH-TITE® or STAIR-TITE™ increases construction costs due to the requirement of additional materials and increased installation time.

"Black Iron" is another form of bridging which pre-dates the claimed invention. "Black Iron" comprises a metal "u"-shaped channel which is run through the parallel apertures of the parallel studs to reinforce the parallel studs. "Black Iron" fails to incorporate any means for fire stop or backing for hand rails or grab bars. Accordingly, a separate fire stop device and backing device must be employed to obtain the results of the claimed invention. The installation of these two additional devices in combination with "Black Iron" increases construction costs due to the requirement of additional materials and increased installation time.

SUMMARY OF THE INVENTION

The invention disclosed by this patent discloses a uniquely shaped metal bridge, back and fire-stop for use in the construction of interior walls.

It is accordingly, an object of the invention to provide largest percentage of closure between metal studs thereby forming a fire stop (also known as a draft dampener) within the completed wall assembly to stop the travel of fire within a wall structure. It is an additional object to provide a metal backing for the installation of handrails and grab bars in conformity with requirement of the Americans with Disabilities Act and Uniform Building Code requirements.

It is an additional object of this invention to reinforce the strength of metal studs permitting the use of higher gauge metal studs and obviating the need for Black-Iron Channel reinforcement or other existing bridging technology between studs resulting in construction cost savings.

The claimed invention comprises a unitary elongated metal plate installed perpendicularly between two metal studs. The one piece elongated metal plate comprises two ends. The ends are bent perpendicular to the elongated metal plate and alternately to each other to form a flange on each end to permit the fastening of the elongated plate to the adjacent stud. In addition to the perpendicular flange, one of the two elongated ends incorporates two parallel notches, one on each side of the elongated plate, to accommodate insertion of the elongated plate between the flanges formed by the cavity of "C"-shaped stud. The horizontal sides of the elongated plate are folded downward and perpendicular to the elongated plate forming downward flanges on each side of the elongated plate. One of the horizontal downward flanges extends further down than its counterpart to form the claimed backing mechanism for the attachment of handrails and grab bars.

It is another object of the present invention to provide a new and improved metal stud bridge, backing and fire stop comprising one unitary device which may be easily and efficiently manufactured and marketed.

It is a further object of the present invention to provide a new and improved metal stud bridge, backing and fire stop which is of durable and reliable construction.

An even further object of the present invention is to provide a new and improved metal stud bridge, backing and fire stop device which is low cost to manufacture with regard to both materials and labor, and which is susceptible to low prices of sale to the consuming public, thereby making the claimed invention economically available to the buying public.

Still yet another object of the present invention is to provide a new and improved metal stud bridge, backing and fire stop which provides in the apparatuses and methods of the prior art some of the advantages thereof, while simultaneously overcoming some of the disadvantages normally associated therewith.

These together with other objects of the invention, along with various features of novelty which characterize the invention, are pointed out with particularity in the claims annexed to and forming part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

These and other objects and advantages of the invention will be more readily apparent when considered in relation to the preferred embodiments of the invention as set forth in the specification and shown in the drawings. Referring now to the drawings which illustrate the invention as follows.

DETAILED DESCRIPTION OF THE PREFERRED EMBODIMENT

Figure 1:
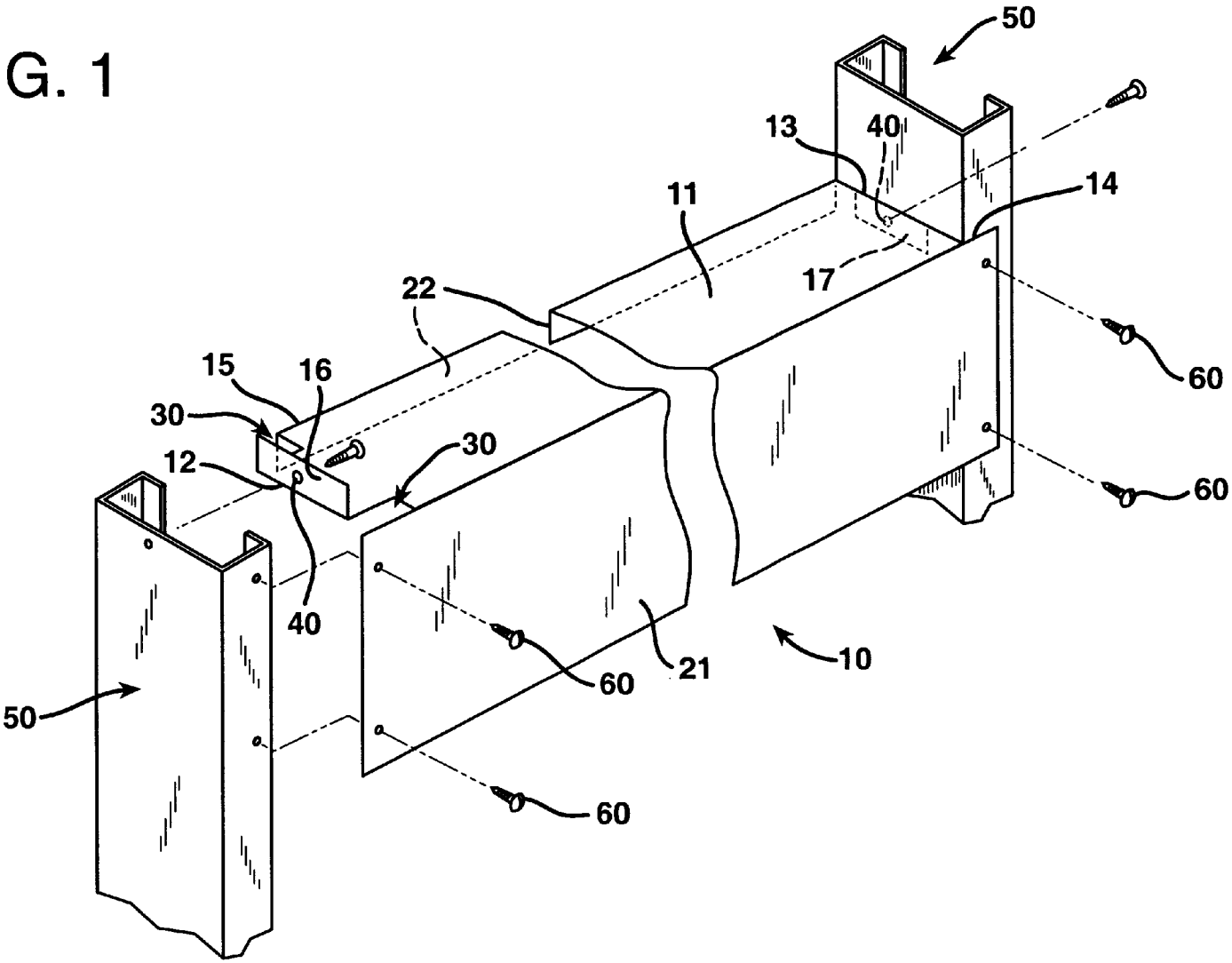
FIG. 1 is a perspective view of the unitary metal frame bridge, fire stop and backing device oriented between vertical parallel studs.
Figure 2:
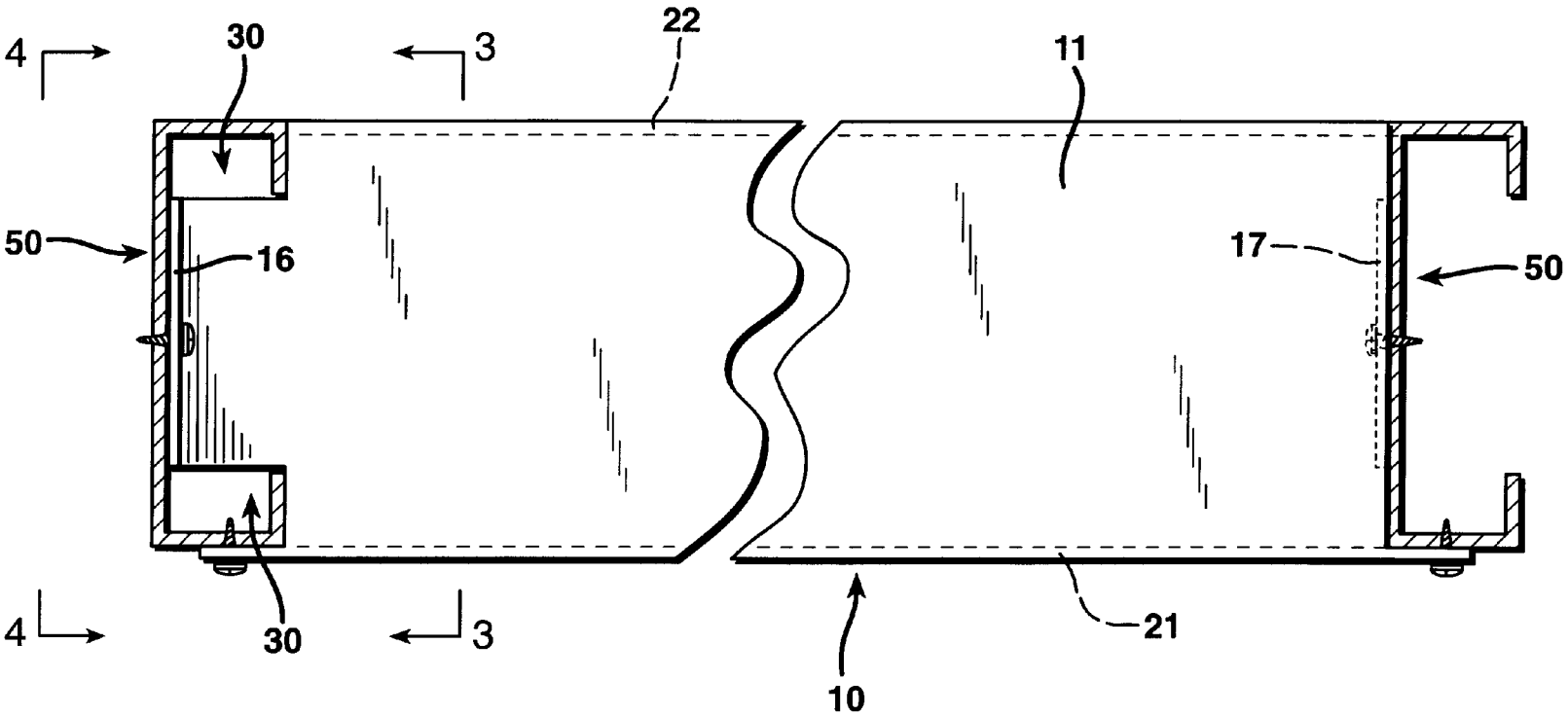
FIG. 2 is a downward view of the unitary metal frame bridge, fire stop and backing device in FIG. 1.
Figure 3:
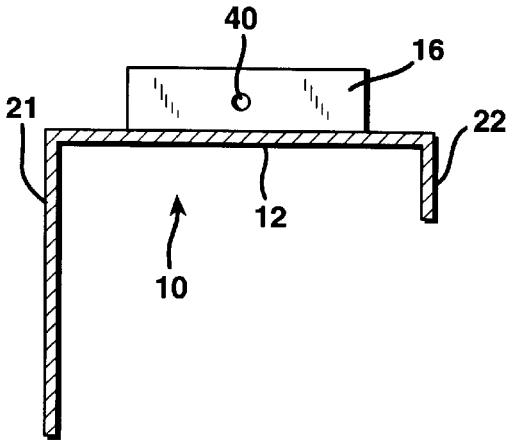
FIG. 3 is a sectional elevational view taken along the lines of 3—3 FIG. 2.
Figure 4:
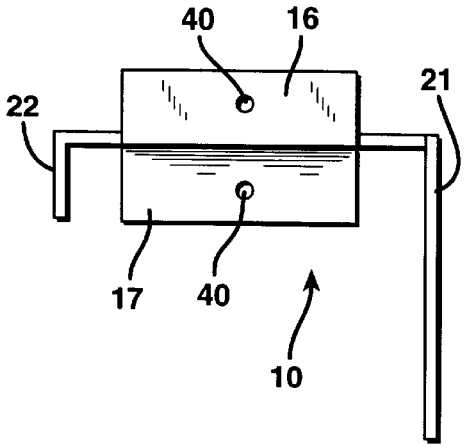
FIG. 4 is an end view of the unitary metal bridge, fire stop and backing device along the lines of 4—4 in FIG. 2.
Figure 6:
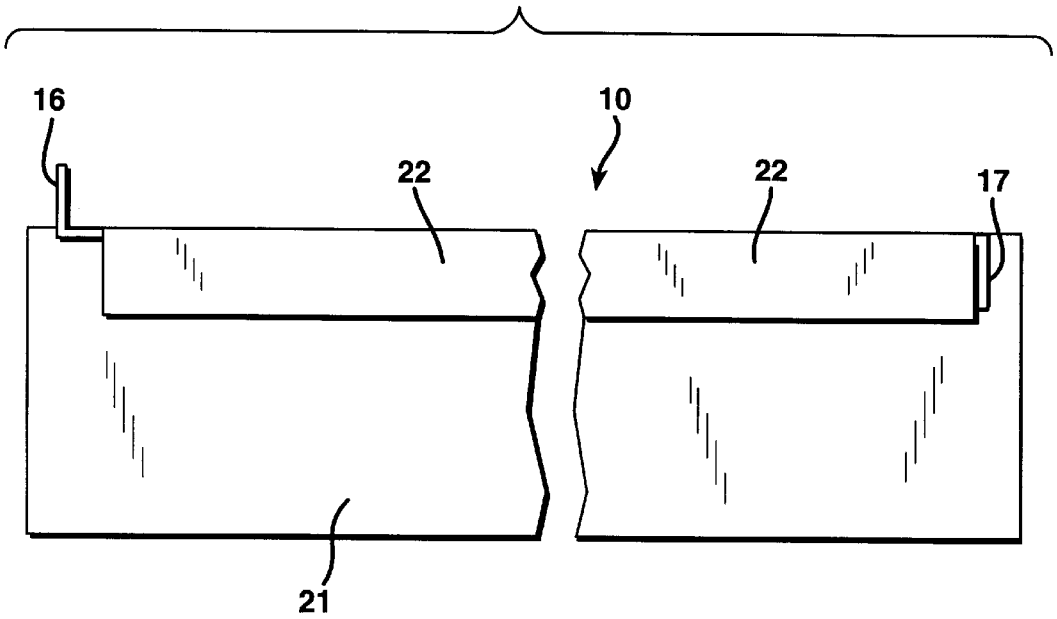
FIG. 6 is a back-end view of the unitary metal frame bridge, fire stop and backing device in FIG. 1.
Figure 5:
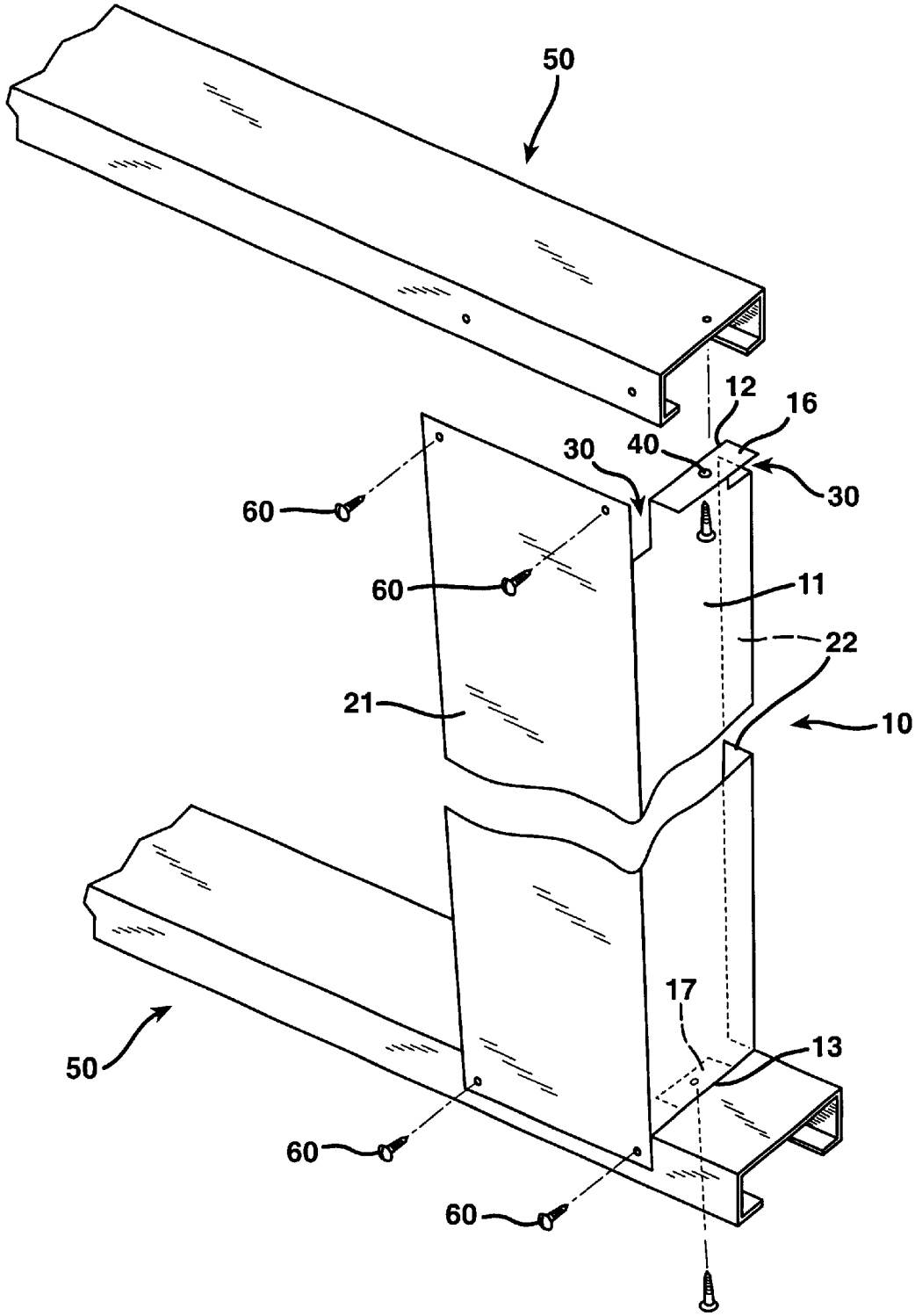
FIG. 5 is a perspective view of the metal ridge, fire stop and backing device oriented between horizontal parallel studs.

Referring now to the drawings, and particularly to FIGS. 1 and 2, the claimed unitary metal bridge, fire stop and backing device is illustrated and generally designated by numeral 10. The claimed invention is best fabricated using galvanized steel. However, any pliable fire-resistant material may be used. The easiest and most efficient means to manufacture the claimed invention is to use a progressive die set in a mechanical press.

The unitary metal bridge, fire stop and backing device depicted in FIGS. 1 and 2 comprises a unitary elongated metal plate-like member (11) formed of a finite length defined by two parallel upright studs (50). The elongated metal plate-like member (11) terminates in a first end (12) and a second end (13). The plate-like member further possesses a first horizontal edge (14) and a second horizontal edge (15) between the first end (12) and second end (13).

The first end (12) and second end (13) of the elongated metal plate-like member (11) are alternately bent perpendicular to the elongated metal plate to form a first flange (16) on said first end (12) and a second flange (17) on said second end (13) to permit the fastening of the elongated plate to the surface of the adjacent parallel upright studs (50). The preferred method of fabrication is to have the first end (12) bent upwards to form the first flange (16), and the second end (13) bent downward to form the second flange (17). It is also preferable that the first flange (16) and second flange (17) are one inch in length. The preferred method to attach the claimed invention to the parallel studs (50) is the use of self-tapping screws through the first flange (16) and second flange (17) into the parallel stud (50). The preferred embodiment further incorporates at least one pre-punched hole (40) of ⅛ inch diameter in the first flange (16) and second flange (17) to permit the attachment of the claimed invention to the parallel studs (50). The preferred method of attaching the device to the parallel studs is with self-tapping screws through the pre-punched holes (40) incorporated in the first flange (16) and second flange (17).

The first end (12) of the elongated metal plate-like member (11) incorporates a pair of parallel notches (30) along the horizontal axis to accommodate the marginal lips of the "u" -shaped studs. The width and length of the parallel notches is variable depending upon the size of the marginal lips possessed by the flanges of each parallel stud. The parallel notches (30) are formed from the first end (12) along the horizontal axis of the metal elongated plate like member prior to forming the first flange (16). Each notch is ⅝ of an inch wide and 3 inches long along the horizontal edge of the elongated metal plate-like member prior to forming the first flange (16). Upon forming the first flange (16), the parallel notches comprise two inches in length along the horizontal edge and ⅝ inch wide.

The first horizontal edge (14) and the second horizontal edge (15) of the elongated plate are folded downward and perpendicular to the elongated plate forming a first downward flange (21) and a second downward flange (22) respectively. The first downward flange (21) of the first horizontal edge (14) is substantially longer than the second downward flange (22) of the second horizontal edge (15). It is preferred that the first downward flange (21) extends downward four inches. To further facilitate installation of the claimed invention to the stud adjacent and provide the necessary anchorage for withstanding 250 pounds of point load pressure for the addition of wall structures such as hand rails and grab bars, a self-tapping screw (60) must be incorporated in each corner of the first downward flange (21). It is preferred that the second downward flange (22) extend downward a half inch. The width of first downward flange extends to and overlaps half of each parallel adjacent stud (50) which define the width of said elongated metal plate-like member. By limiting the overlap of the first downward flange over the adjacent stud to only half of the width of the stud permits the installation of series of the claimed invention between multiple parallel studs in the same plane.

Having completed a detailed disclosure of the preferred embodiments of my invention, so that those skilled in the art may practice same, I contemplate variations may be made without departing from the essence of the invention claimed herein.

I claim:

1. A unitary metal bridge, fire stop and backing device for use with metallic studs wherein said studs are formed with a spaced opening, said bridging, backing and fire stop comprising:

a unitary elongated metal plate-like member formed of a finite length defined by two parallel upright studs;

said unitary elongated metal plate-like member terminates in a first end and a second end;

said unitary plate-like member possesses a first horizontal edge and a second horizontal edge between the first end and second end;

said first end and second end of the elongated metal plate-like member are alternately bent perpendicular to the elongated metal plate to form a first flange on said first end and a second flange on said second end to permit the fastening of the elongated plate to the surface of the adjacent parallel upright studs;

said first end of the elongated metal plate incorporates a pair of parallel notches along the horizontal axis;

said first horizontal edge and the second horizontal edge of the elongated plate are folded downward and perpendicular to the elongated plate forming a first downward flange and a second downward flange;

said first downward flange of the first horizontal edge is substantially longer than the second downward flange of the second horizontal edge and the width of first downward flange is greater than the width of said elongated plate-like member.

2. Said unitary metal bridge, fire stop and backing device defined in claim 1 wherein said first downward flange extends four inches downward from the first horizontal side of the elongated plate-like member.

3. Said unitary metal bridge, fire stop and backing device defined in claim 1 wherein the placement and size of said parallel notches is defined by the width of the spaced opening of the vertical stud adjacent to said first end of elongated plate-like member.

4. Said unitary metal bridge, fire stop and backing device as defined in claim 1 wherein said unitary metal bridge, fire stop and backing device from light gauge galvanized steel.

5. Said unitary metal bridge, fire stop and backing device as defined in claim 1 wherein said first end flange and said second end flange possess a pre-punched hole for the attachment of said unitary metal bridge, fire stop and backing device to said parallel vertical studs using an attachment means.

6. Said unitary metal bridge, fire stop and backing device in claim 5 wherein said attachment means comprise self-tapping screws.

7. A unitary metal bridge, fire stop and backing device for use with metallic studs wherein said studs are formed with a spaced opening, said bridging, backing and fire stop comprising:

a unitary elongated metal plate-like member formed of a finite length defined by two parallel horizontal studs;

said unitary elongated metal plate-like member terminates in a first end and a second end;

said unitary plate-lie member possesses a first vertical edge and a second vertical edge between the first end and second end;

said first end and second end of the elongated metal plate-like member are alternately bent perpendicular to the elongated metal plate to form a first flange on said first end and a second flange on said second end to permit the fastening of the elongated plate to the surface of the adjacent parallel horizontal studs;

said first end of the elongated metal plate-like member incorporates a pair of parallel notches along the vertical axis;

said first vertical edge and the second vertical edge of the elongated plate-like member are folded downward and perpendicular to the elongated plate-like member forming a first horizontal flange and a second horizontal flange respectively;

said first horizontal flange of the first vertical edge is substantially longer than the second horizontal flange of the second vertical edge and the width of first horizontal flange is greater than the width of said elongated plate-like member.

* * * * *

UNITED STATES PATENT AND TRADEMARK OFFICE

CERTIFICATE OF CORRECTION

PATENT NO. : 6,260,318 B1
DATED : July 17, 2001
INVENTOR(S) : Thomas Ross Herren It is certified that error appears in the above-identified patent and that said Letters Patent is hereby corrected as shown below:

Column 2,
Line 1, insert -- of -- between "installation" and "wall".
Line 2, delete "must" before "which" and insert -- must -- after "which".
Line 6, insert -- the -- between "in" and "construction".
Line 53, "with stand" should read -- withstand --.

Column 3,
Line 18, change "cheaper" to read -- more economical --.

Column 4,
Line 13, after "provide" insert -- the --.
Line 14, before "largest" insert -- the --.

Column 7,
Line 17, after "device" insert -- is constructed --.

Signed and Sealed this

Nineteenth Day of March, 2002

*Attest:*

*Attesting Officer*

JAMES E. ROGAN
*Director of the United States Patent and Trademark Office*